United States Patent [19]

Todaro et al.

[11] Patent Number: 5,017,071

[45] Date of Patent: May 21, 1991

[54] MACHINE FOR AUTOMATICALLY BINDING BOOKS WITH FLEXIBLE STUD BINDING STRIPS

[75] Inventors: Frank A. Todaro, Clinton; Peter Hotkowski, Chester, both of Conn.

[73] Assignee: VeloBind, Inc., Fremont, Calif.

[21] Appl. No.: 360,880

[22] Filed: Jun. 2, 1989

[51] Int. Cl.[5] ..... B42B 9/00

[52] U.S. Cl. ..... 412/43; 156/477.1; 83/372; 412/7; 412/16

[58] Field of Search ..... 156/477.1; 83/372; 412/7, 16, 43

[56] References Cited

U.S. PATENT DOCUMENTS

| | | | |
|---|---|---|---|
| Re. 28,202 | 10/1974 | Abildgaard et al. | 412/16 X |
| 3,811,146 | 5/1974 | Abildgaard et al. | 412/43 X |
| 4,270,970 | 6/1981 | Szanto et al. | 156/477.1 |
| 4,369,013 | 1/1983 | Abildgaard et al. | 412/43 X |
| 4,442,743 | 4/1984 | Szanto | 83/372 |
| 4,645,399 | 2/1987 | Scharer | 412/16 |
| 4,656,716 | 4/1987 | Hymmen | 29/270 |
| 4,674,906 | 6/1987 | Abildgaard | 402/80 P |
| 4,685,700 | 8/1987 | Abildgaard | 281/21 R |
| 4,846,616 | 7/1989 | Abildgaard et al. | 412/7 |

*Primary Examiner*—Paul A. Bell

*Attorney, Agent, or Firm*—Julian Caplan

[57] ABSTRACT

Apparatus is used with two binding strips, the first having at least four studs projecting therefrom which are flexible and the second having holes complementary to the studs and for each hole a groove extending therefrom toward the center of the second strip. The apparatus moves to a position aligned with holes in a stack of sheets. The second strip is deposited on top of the stack with the holes thereof aligned with the holes in the sheets. The first strip is then raised so that the studs pass through the holes in the sheets and the second strip and pressure is applied forcing the strips toward each other. Blocks then move transversely, bending down the portions of the studs projecting beyond the second strip and snapping these portions into the grooves. The steps are performed sequentially using a single pneumatic cylinder for all but the first-mentioned step.

18 Claims, 11 Drawing Sheets

MACHINE FOR AUTOMATICALLY BINDING BOOKS WITH FLEXIBLE STUD BINDING STRIPS

CROSS-REFERENCE TO RELATED APPLICATIONS

Reference is made to co-pending application Ser. No. 116,045, filed 11/2/87, now U.S. Pat. No. 4,846,616 entitled BENDING APPARATUS FOR FLEXIBLE STUDS OF BINDING STRIPS, which shows apparatus for manually bending over flexible studs so that they snap into grooves in the female binding strip. The present invention comprises an improvement thereon in the sense that the machine of the present invention is automatic.

BACKGROUND OF THE INVENTION

1. Field of the Invention

This invention relates to a new and improved machine which automatically binds apertured sheets with the use of plastic binding strips such as are shown in FIGS. 23 to 25 of U.S. Pat. No. 4,685,700, or in U.S. Pat. No. 4,674,906. The machine receives female binding strips from a source such as a cassette of the type shown in U.S. patent application Ser. No. 115,999, filed 11/2/87, and also receives male binding strips of the type shown in said last-mentioned U.S. patent application from a corresponding source. At the same time, suitably apertured sheets are received in a tray positioned forwardly of the machine. The carriage of the machine is advanced toward the tray until the holes in the female strip are aligned with the holes in the stack of sheets and the studs of the male strip are aligned with the holes of the sheets. Thereupon, the female strip is positioned on top of the stack of sheets. Next, the male strip is driven toward the stack of sheets, the studs penetrating the holes in the sheets and the holes in the female strip. Binding pressure is applied, forcing the strips toward each other. Thereupon the ends of the studs projecting beyond the female strip are bent inwardly, the studs snapping into grooves on the outer surface of the female strip to complete the bind.

2. Description of Related Art

As has been previously stated, the binding strips used with the present invention are shown in assignee's U.S. Pat. No. 4,685,700 FIGS. 23 to 25 and in U.S. Pat. No. 4,674,906. Cassettes in which these strips may be held for transportation and storage are shown in U.S. patent application Ser. No. 115,999. Means whereby strips may be removed from such cassettes one at a time and fed transversely into an assembly station are shown in U.S. patent application Ser. No. 116,045, now U.S. Pat. No. 4,846,616.

Means for assembling apertured sheets and strips are shown in assignee's U.S. patent application Ser. No. 116,045, filed 11/2/87, now U.S. Pat. No. 4,846,616. The binding means disclosed in the latter application cuts off the excess lengths of the studs and forms heads on the ends thereof to secure the binding of the book.

The present invention differs from previous binding machines in that instead of the studs being cut off and headed, they are bent at 90 degrees and forced into grooves in the outer surface of the female strip. One prior means for manually bending such studs and forcing the same into grooves is shown in assignee's co-pending application Ser. No. 313,248, filed Feb. 21, 1989 now U.S. Pat. No. 4,906,157 issued Mar. 6, 1990. The present invention employs different means for bending the studs and its operation is automatic rather than manual.

SUMMARY OF THE INVENTION

A carriage is mounted on a stationary frame to move horizontally from a retracted loading or rearward position to a forward or binding position. As it moves forwardly it aligns with a tray in which suitably apertured sheets have been accumulated. The carriage extends vertically above the base and supports for vertical reciprocation a closer section at its top and a male strip driver section at the bottom. Actuation of the various mechanisms mounted on the carriage is by means of a substantially vertically extending pneumatic cylinder pivotally mounted on the male driver portion and having an upward extending rod attached to a crank arm fixed to a horizontal longitudinally extending crank shaft in the upper section. By the choice of the modulus of several springs hereinafter described, a sequence of operation is controlled so that as the rod is retracted into the cylinder, a series of steps is performed.

Initially, in the loading position of the carriage, a female strip is supported on top of a female strip support rail in the upper section of the carriage. Meanwhile a male strip is supported on a male driver bar and held in upright position by pivotally mounted strip guide plates.

As the carriage is moved forward and encounters the tray on which the sheets are supported, the tray pushes the female strip support rail rearward against the force of a compression spring, but simultaneously clamps engage at the extreme outer ends of the female strip to hold it in place.

As the main air cylinder is actuated, the first step is to lower the upper section so that the female strip is brought into contact with the top of the stack of sheets and as it approaches this position the clamps are retracted. The female strip is held in close contact with the top of the stack by depending legs of a closer back plate, the actuation of which is hereinafter described.

Further actuation of the main cylinder causes the male strip driver bar to move upwardly, which in turn causes the outer ends of the studs to penetrate first the holes in the stack of sheets and then the holes in the female strip and then to cause the male strip guide plates to pivot out of the way, allowing the male strip to come into final contact with the paper surface. Upward movement of the male strip driver bar as controlled by the main air cylinder is resisted by springs which are overcome when the desired clamping pressure is applied to the two strips. Thereupon the crank shaft is turned, causing the downward extending legs of the closer back plates to move horizontally transversely inwardly; the lower ends of the legs bending the portions of the studs which extend above the female strip toward the center of the machine and depressing the bent stud portions into the grooves on the upper surface of the female strips.

Reversal of the movement of the cylinder rod relative to the cylinder restores the movable portions of the carriage to their initial position and thereupon the carriage is moved rearwardly to its loading position for the next cycle of operation.

Other objects of the present invention will become apparent upon reading the following specification and referring to the accompanying drawings in which similar characters of reference represent corresponding parts in each of the several views.

IN THE DRAWINGS

DESCRIPTION OF PREFERRED EMBODIMENT

Book Components

Figure 1:
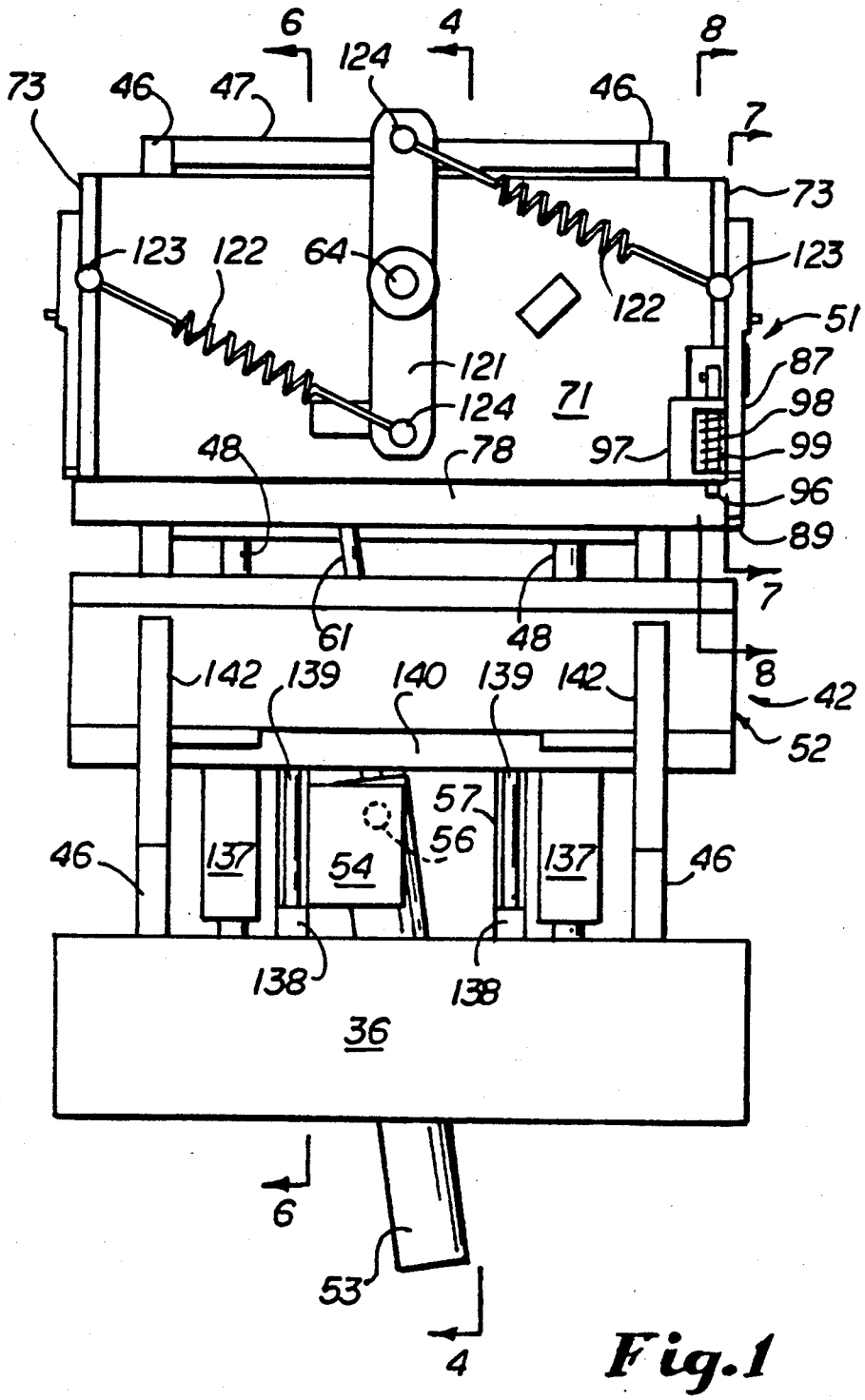
FIG. 1 is a front elevational view of the machine.

Male binding strip 21 is a piece of thin, narrow, plastic material from which projects upwardly a plurality of longitudinally spaced studs 22 characterized by the fact that the studs may be bent at approximately 90 degree angles at any point along the lengths of the studs. Used with the strip 21 is a female strip 23 of the same length and width, but preferably slightly thicker, formed with spaced holes 24 complementary to studs 22. On the outer face of the strip 23 are grooves 26 extending toward the center of the strip from each of the holes 24. The grooves 26 have overlapping lips so that when the studs 22 are bent down into the grooves 26 they are held therein in a snap action. The sheets 27 are formed spaced slightly inward from their spine edges with holes 28 spaced at the same intervals as the studs 22.

As illustrated in the accompanying drawings, there are four studs 22 and a corresponding number of holes 24, grooves 26 and holes 28. It will be understood that the number of such features may be increased or decreased.

Strips 21 may be packaged in cassettes similar to those shown in U.S. patent application Ser. No. 115,999, filed 11/2/87, and strips 23 may also be initially packaged in such cassettes. By means not herein illustrated and described, but shown in detail in U.S. patent application Ser. No. 116,045, the cassettes may be placed in a hopper from which they are fed one at a time, each strip being then fed in the direction of its length into an assembly apparatus. Mechanisms such as is shown in said application Ser. No. 115,999 may be used in conjunction with the present invention to feed the strips into the binding machine.

The punched sheets are assembled on a conveyor 31 with the edge along which the holes 28 are formed positioned rearwardly. A rail 32 extends vertically upward from conveyor 31 and the edges of sheets 27 abut such rail 32. Rail 32 has an inward projection 33. Conveyor 31 preferably originates at a printer, copier or other source of printed sheets 27. Assembled stacks of such sheets are moved along the conveyor intermittently and are stopped opposite the binding machine.

Figure 6:
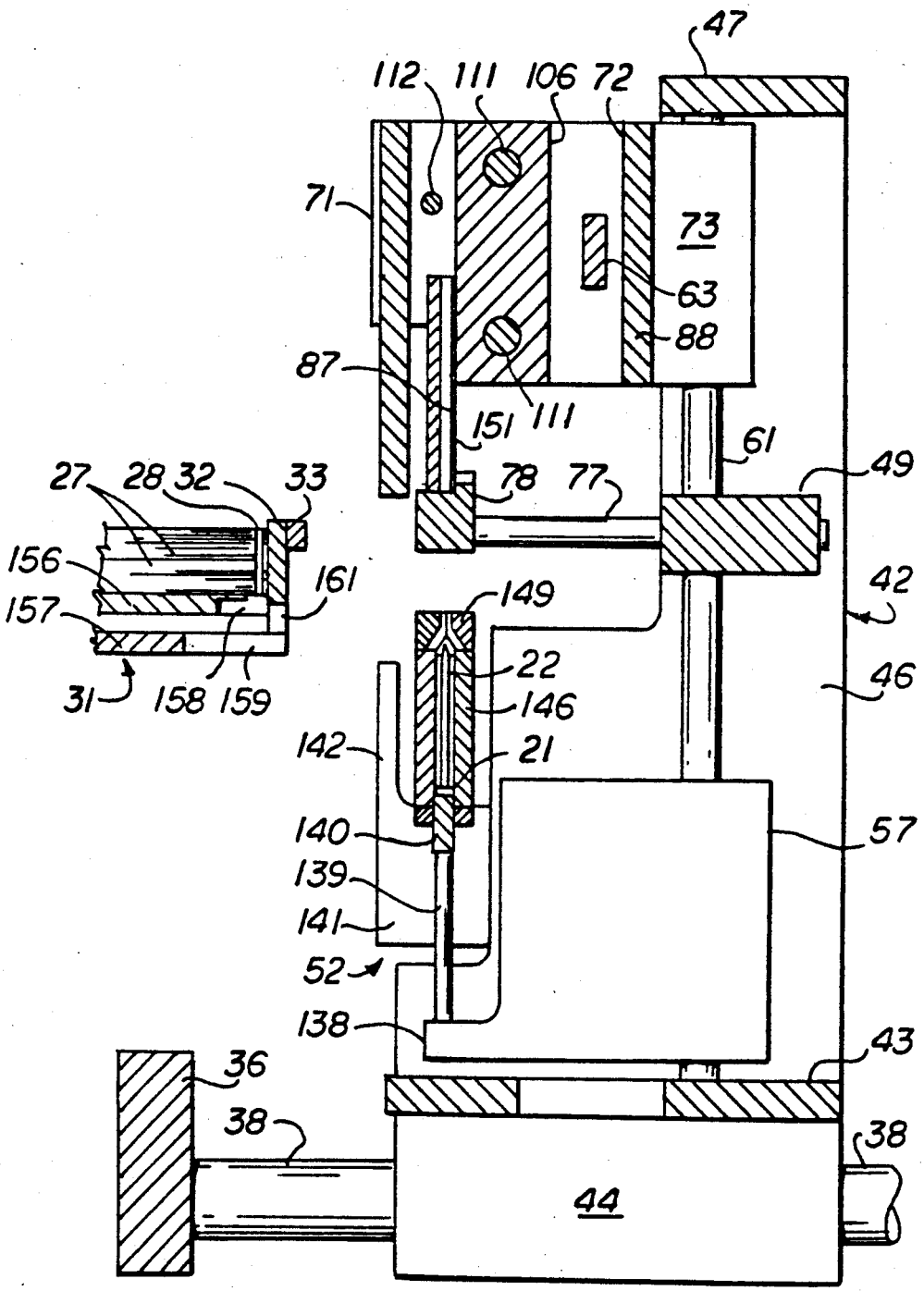
FIG. 6 is a sectional view taken substantially along line 6—6 of FIG. 1.
Figure 6A:
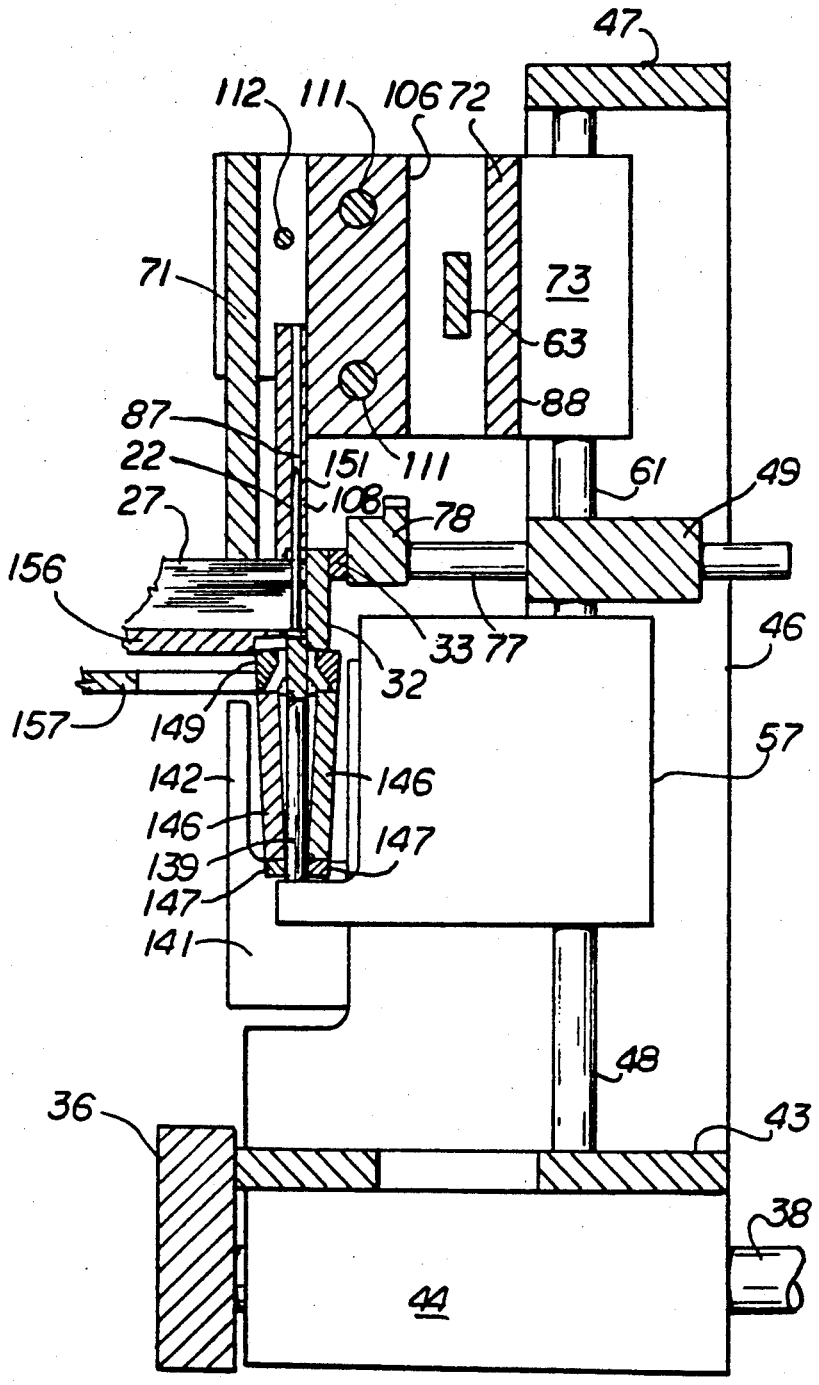
FIG. 6A is a view similar to FIG. 6 showing the machine in different positions of its cycle of operation.

Details of construction of conveyor 31 are best shown in FIG. 6. Thus, the conveyor includes a platen 156 on which the sheets 27 actually rest. The main frame of the conveyor 157 is below the platen 156 and is fixed relative to the frame of the machine. Platen 156 has an opening 158 below the holes 28 in sheets 27 and the support 157 has an opening 159 below the opening 158. There is also a side opening 161 in rail 32. The openings 158, 159 and 161 provide for insertion of the male strip 21 and its driver at an appropriate point in the sequence of operation of the machine.

Frame, Carriage and Cylinders

Figure 2:
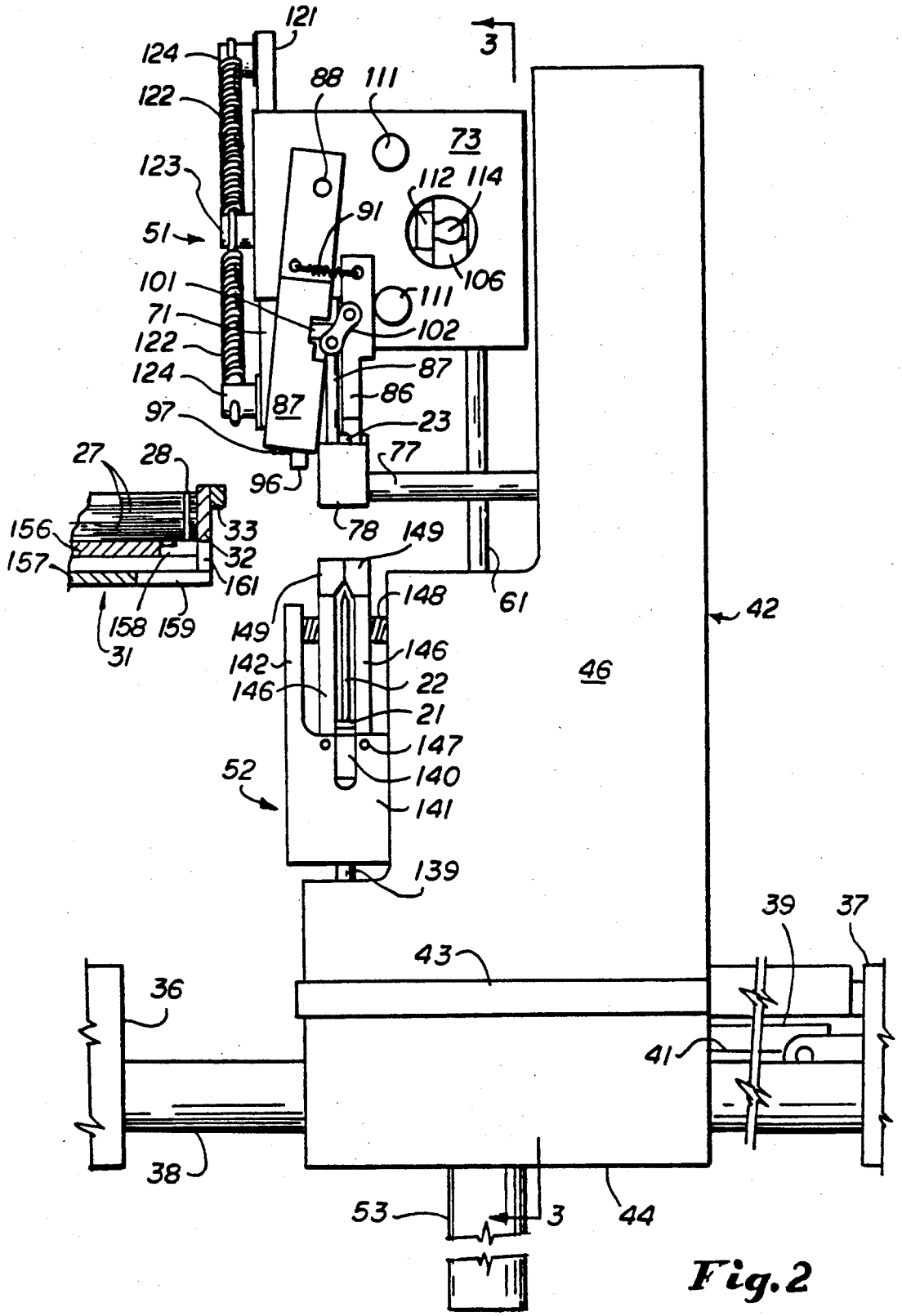
FIG. 2 is a side elevational view thereof as viewed from the right of FIG. 1.

As described herein, and as illustrated in FIG. 1, the front of the machine is at the left side of FIG. 2 and the rear at the right side. Transverse horizontal front base plate 36 and rear base plate 37 are suitably supported above the floor by means not shown and are interconnected by horizontal longitudinal ways 38. Pivotally connected to rear plate 37 is a pneumatic cylinder 39, the forward extending rod 41 of which is attached to horizontal longitudinally reciprocating carriage 42, which extends up above the level of plates 36 and 37 and is hereinafter described in detail.

Carriage 42 has a horizontal carriage base plate 43 to the lower side of which are fastened pillow blocks 44 which receive the ways 38 so that the carriage 42 may reciprocate along ways 38. Extending up from plate 43 are carriage sides 46, the shape of which is best shown in FIG. 2 and the upper ends of which are interconnected by top bar 47, to complete a rigid open box-like subassembly. Extending vertically between carriage base plate 43 and top bar 47 are vertical ways 48. Fixed at either end to carriage sides 46 and also to vertical ways 48 is an intermediate horizontal transverse crossbar 49.

Vertically movable along ways 48 are the upper section 51 and lower section 52 of carriage 42. Extending substantially vertically within the carriage 42 is main pneumatic cylinder 53, the latter being attached to trunnion 54 by pivot 56. Trunnion 54 is fixed to one of several rear extensions 57 of the sub-assembly including members 57, 138, 139 and 140. The upward extending rod 61 of cylinder 53 carries a clevis 62 at its upper end which is pivotted to one of the oppositely disposed crank arms 63 fixed to horizontal longitudinal crank shaft 64. Shaft 64 is fixed to upper carriage section 51.

Upper Carriage Section

Upper carriage section 51 is formed about a horizontal transverse front 71, rear 72 and longitudinal sides 73, the parts 71, 72, 73 forming a rigid box.

Cross bar 49 is formed with at least two horizontal forward extending bores to receive the rearward ends of horizontal forward extending rail shafts 77. To the forward ends of shafts 77 is attached transverse horizontal rail 78. Rail 78 has raised sections 82 at either end.

Figure 7A:
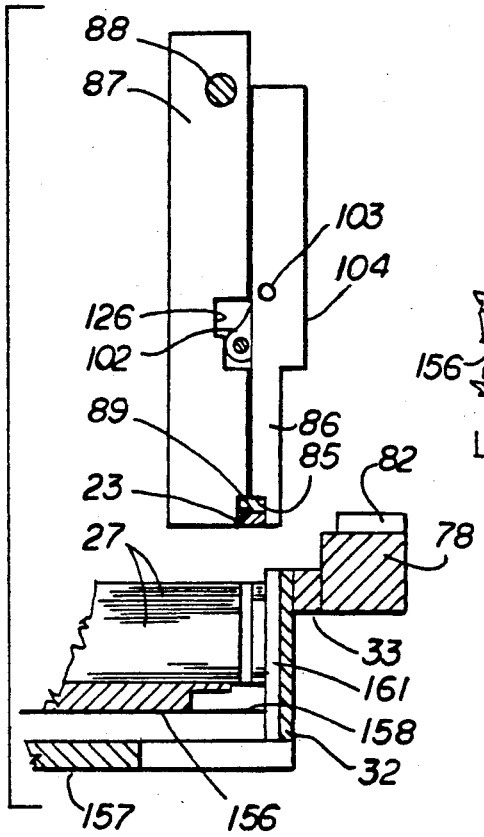
FIGS. 7A and 7B are views similar to FIG. 7 showing the machine in different positions in its cycle of operation.
Figure 7:
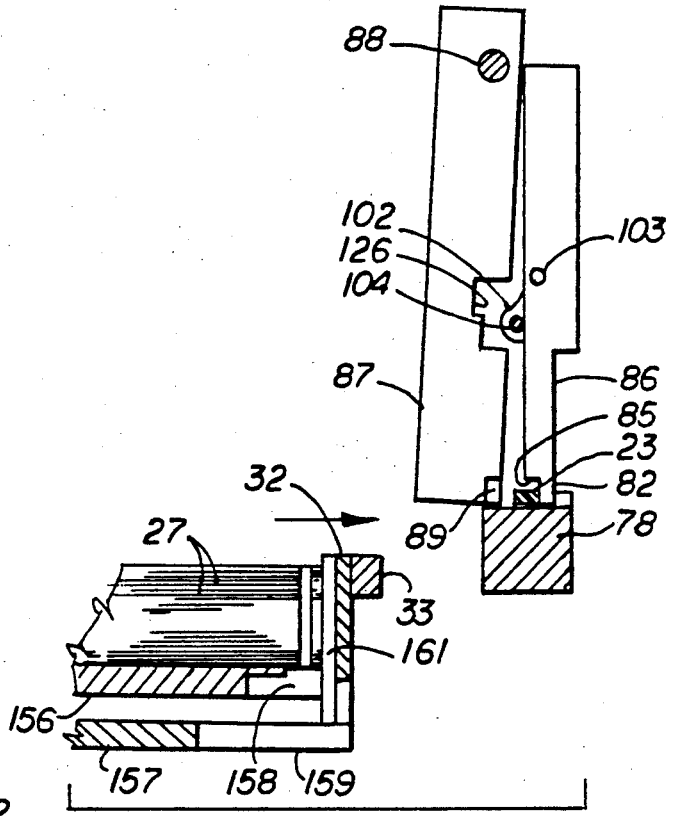
FIG. 7 is a sectional view taken substantially along line 7—7 of FIG. 1.

Sections 82 engage the rear closer block extensions to limit forward movement of rail 78. Shafts 77 and rail 78 are biased forward by springs 79 within bores in bar 49. It will be noted from FIG. 4 that a shoulder 81 is formed on the rear upper edge of rail 78. Female strip 23 is fed from a hopper (not shown) on the left of the machine along rail 78 forward of shoulder 81 and, at the commencement of operation of the machine, is in the position shown in FIG. 4. The outside edges of strip stop arms 86 have notches 85 which engage the side of strip 23 outside the outermost holes 24 as best shown in FIG. 7.

On either side of the machine immediately outside sides 73 are clamps 87 which oscillate in vertical planes about horizontal transverse pivot rod 88. Clamps 87 have notches 89 at their bottom ends. The notches 85 in strip stop arm 86 and notches 89 in clamps 87 cooperate to clamp the outer edges of strip 23 therebetween and to prevent it from falling out of position.

As hereinafter explained, during the course of operation of the machine, projection 33 pushes the rail 78 rearward. Since strip 23 is no longer supported by the rail 78, the clamps 87, biased by springs 91, move counterclockwise as viewed in FIG. 2, clamping strip 23. See FIGS. 7A and 8A.

Figure 7B:
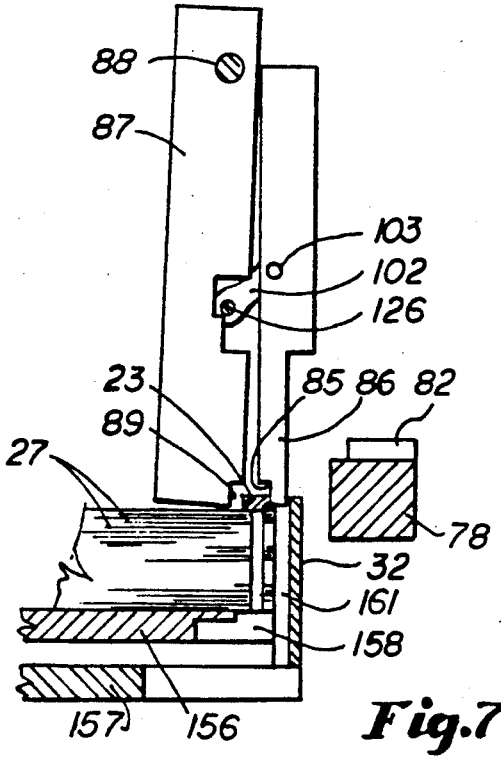

Also as hereinafter described, at a later stage in the cycle of operation of the machine, upper carriage section 51 is lowered by cylinder 53 so that the strip 23 rests on the top of the stack of sheets 27. Mounted on front 71 is a vertically reciprocable reset rod 96 held in place by guides 97 affixed to front 71. Rod 96 is biased downward by spring 98 interposed between the rod guides 97, bearing against roll pin 99 which passes transversely through rod 96. Carried on the upper end of rod 96 is a bifurcated reset arm 101. Link 102 is pivoted by means of pivot 103 at its upper end to strip stop arm 86. The lower end of link 102 carries a pin 104 which fits between the bifurcations of the reset arm 101. As best shown in FIG. 7, there is a notch, or step 126, cut in the edge of clamp 87. Directing attention now to FIG. 7B, the pin 104 rests on the notch 126, locking the clamp 87 in outward position.

Figure 5:
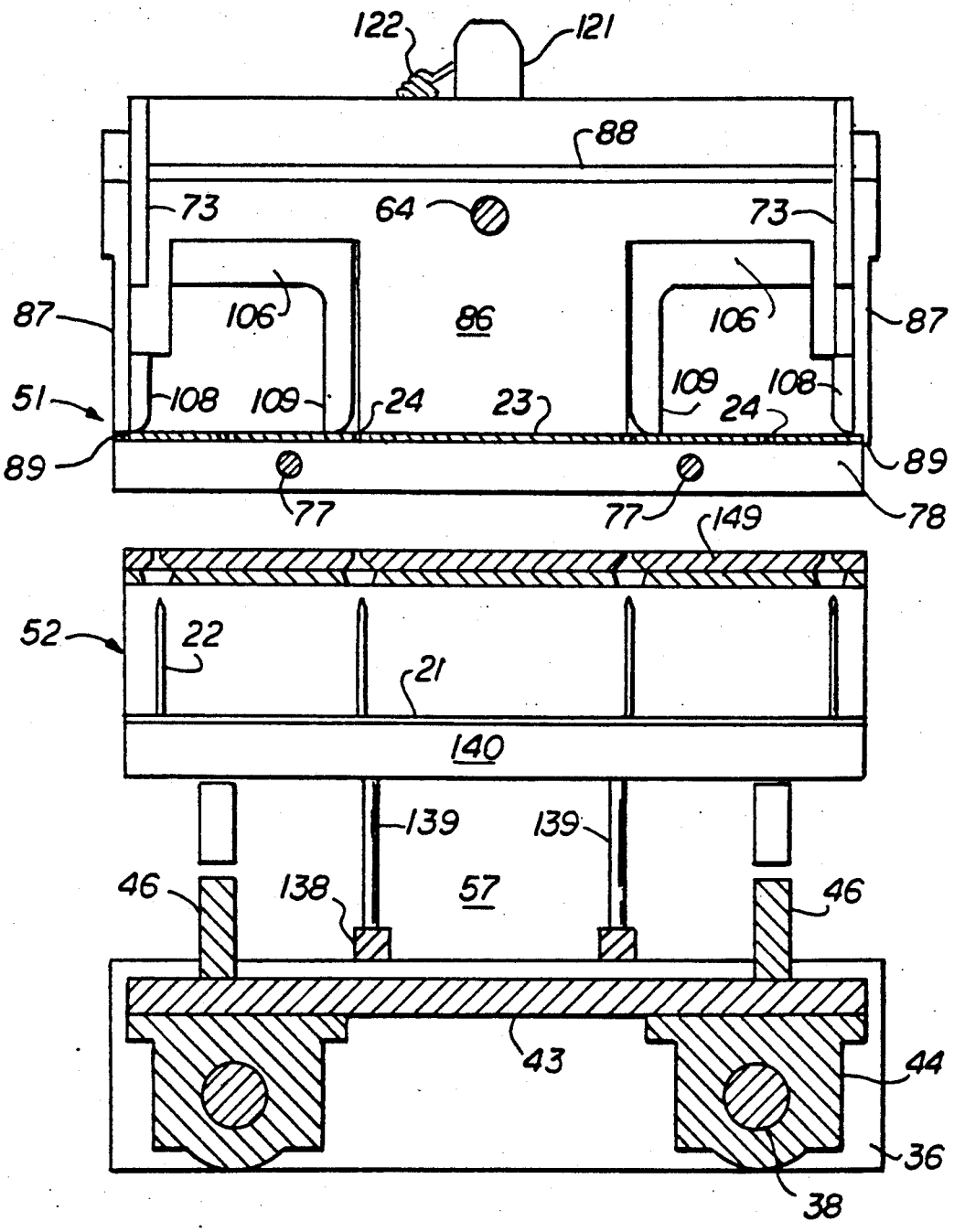
FIG. 5 is a vertical sectional view taken substantially along the line 5—5 of FIG. 4.

Horizontally transversely reciprocating closure blocks 106 have forward extensions 107 from which depend outer feet 108 and inner feet 109, best shown in FIG. 5. The feet 108 and 109 are immediately outside the holes 24 in the strip 23 at the outset of operation of the machine. It will be noted that the inward surfaces of the feet 108 and 109 are curved. Thus, as the feet 108, 109 are brought inward (as hereinafter appears), the curved surfaces bend the ends of the studs 22 projecting above the top of strip 23 toward the center of the strip and force the bent ends into the grooves 26.

Figure 3:
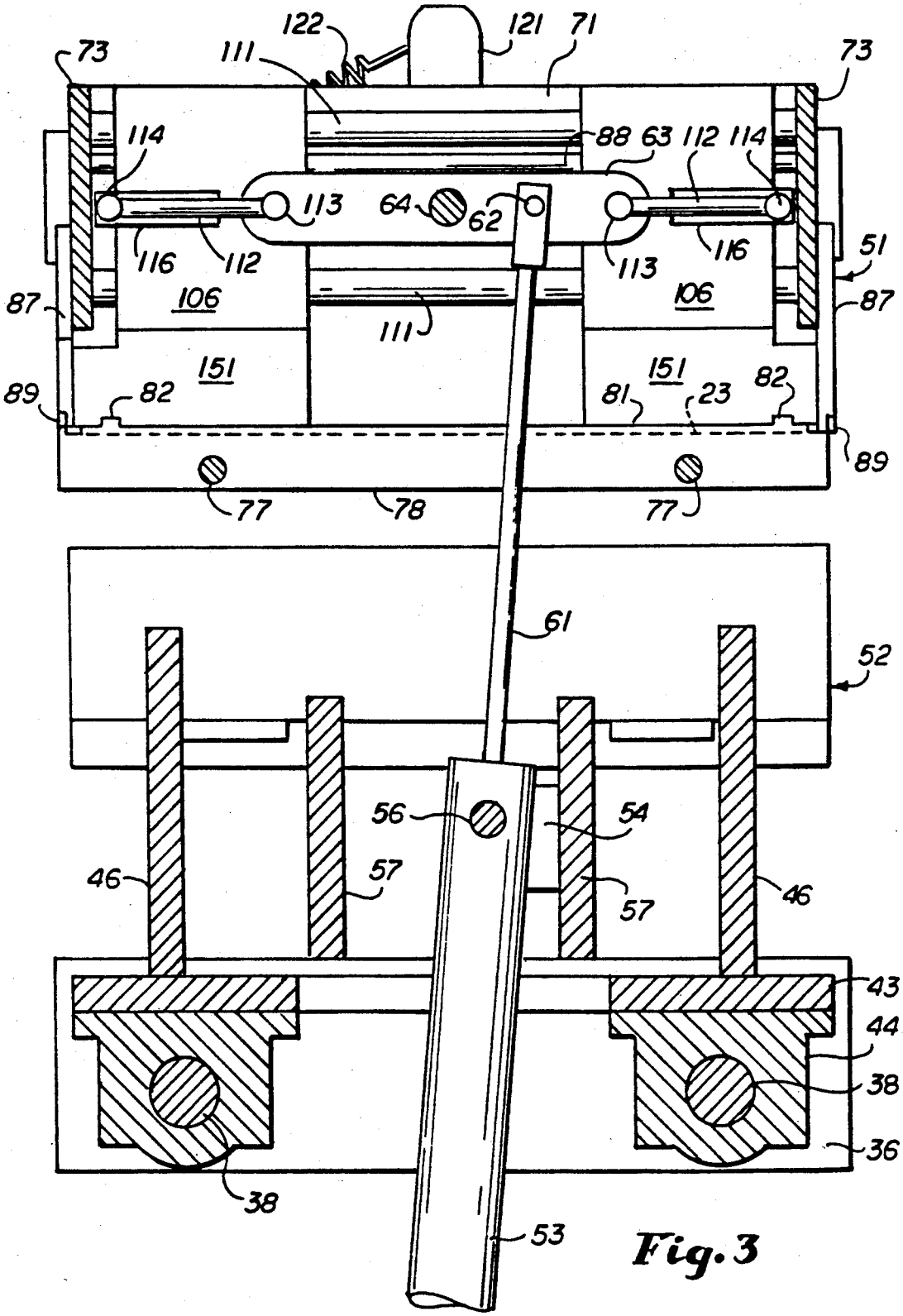
FIG. 3 is a vertical sectional view taken substantially along the line 3—3 of FIG. 2.
Figure 3A:
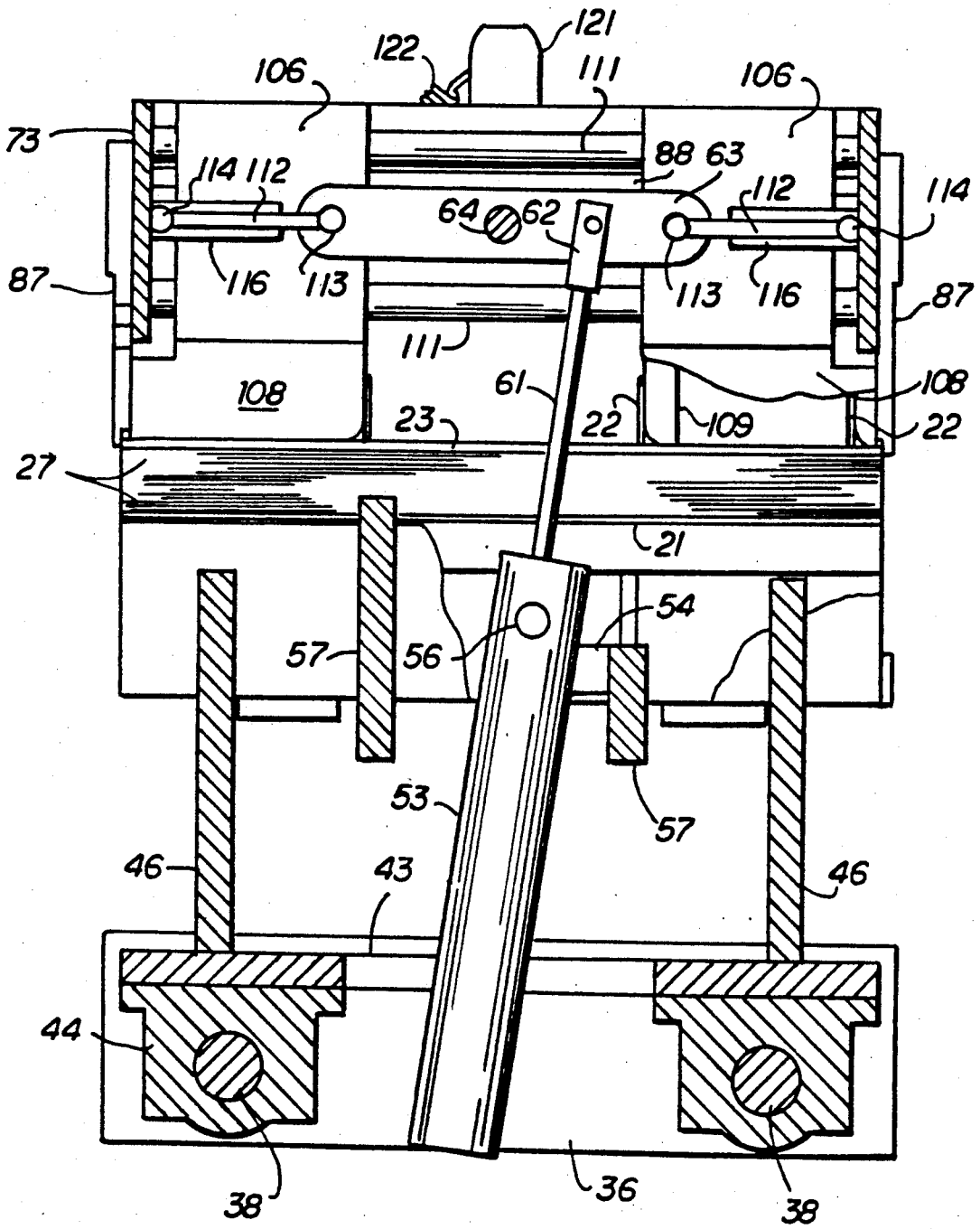
FIGS. 3A and 3B are views similar to FIG. 3 showing the machine in different positions in its cycle of operation, FIGS. 3A and 3B being partially cut away to reveal internal construction.

Actuation of the closer blocks 106 is best shown in FIG. 3. The blocks reciprocate on shafts 111 which pass therethrough and are fixed at their opposite ends of the upper carriage sections sides 73. Directing attention to FIG. 3, the outer ends of the crank arms 63 are pivotally attached to links 112 by inner pivots 113. The outer ends of links 112 are attached by outer pivots 114 to outward extending extension arms 116 fixed to blocks 106. When the rod 61 is contracted within the cylinder 43, arms 63 pivot clockwise around shaft 64 and the links 112 pull the closer blocks 106 inward toward the center. Directing attention now to FIG. 5, this inward movement of blocks 106 causes the feet 108 and 109 to move inward toward the center of the strip 23.

Directing attention now to FIG. 1, on the front of the machine fixed to crank shaft 64 are opposed arms 121. Springs 122 are fixed at their outer ends to anchors 123 attached to sides 73 and at their inner ends are connected to the outer ends of arms 121 by connectors 124. Thus, retractive movement of rod 61 in cylinder 43 is resisted by springs 122 and it is not until the force of springs 122 has been overcome (in the last stage of the cycle of operation of this machine) that shaft 64 is permitted to turn and thereby draw closer blocks 106 toward the center of the machine.

Lower Carriage Section and Associated Male Strip Guide Means

Lower strip section 52 reciprocates vertically between side plates 46 by reason of the fact that the upper section 51 is stopped in its downward movement by contact with the stack of sheets 27 on tray 31 and continued retraction of rod 61 within cylinder 53 causes the trunnion 54 to rise. Pillow blocks 137 which receive vertical ways 48 are fixed to the rear extensions 57. Extending forward from members 57 are extensions 138 and fixed to the upper surfaces thereof are vertically reciprocating driver rods 139 fixed to the lower surface of driver bar 140 which engage the underside of male strip driver bar 140. During the loading portion of the cycle of the machine, a male strip 21 is moved horizontally transversely over the top of driver bar 140. The rods 139 are fixed to the lower surface of bar 140.

Figure 4:
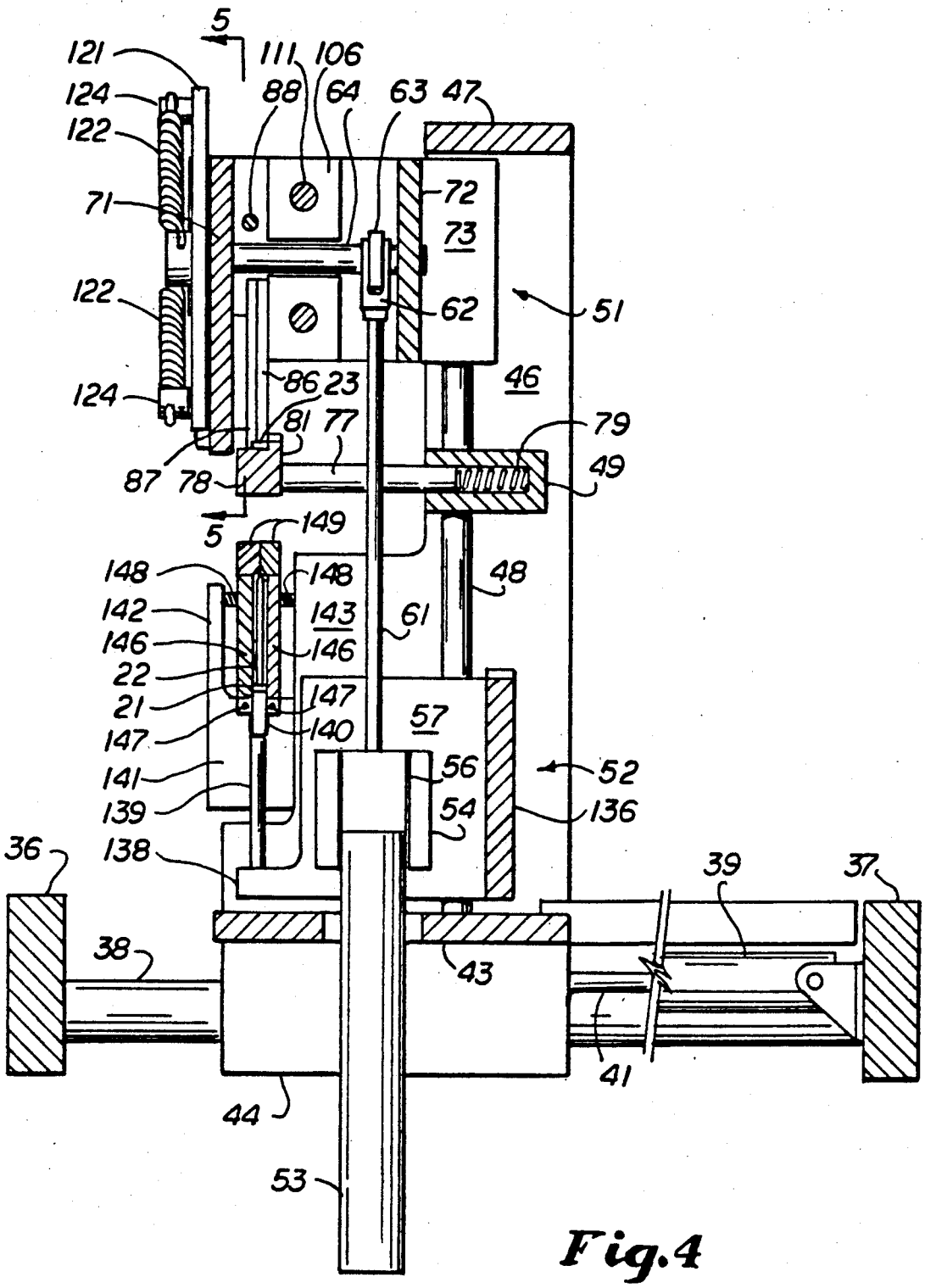
FIG. 4 is a vertical sectional view taken substantially along the line 4—4 of FIG. 1.

A pair of pivot pin blocks 141 is fixed to extend forward from forward extensions 143 of side plates 46 (see FIG. 4). On the front of the machine are upward extensions 142 of blocks 141. The male strip driver bar 140 is initially received in an upward facing recess in pivot pin block 141.

Front and rear strip guides 146 are pivotted at their lower ends by pivots 147 to blocks 141. As best shown in FIG. 4, the opposed inner surfaces of the guides 146 are recessed so that the male strip pins 22 are received therein. The upper end of the cavity created by the recessing of the inner faces of male strip guides 146 is closed off by funnel blocks 149. Compression springs which bear against the outer faces of male strip guides 146 and either the forward face of extension 143 of side 46 or the inner face of upward extension 142 bias the guides 146 and funnel blocks 149 together, thereby assuming the position shown in FIG. 4.

When the male strip driver bar 140 is raised, the upper ends of the studs 22 push through the holes in the funnels formed in funnel bars 149. When the top surface of strip 21 reaches the funnel bars 149, the top surface forces the funnel bars 149 apart, pivoting about the pivots 147 and against the forces of the springs 148. Thus, the strip 21 and pins 22 are forced upward, the upper ends of the studs 22 penetrating first the holes 28 in sheets 27 and then the holes 24 in strip 23. Guides 151 guide studs 22 vertically upward (FIG. 6).

Operation

At the commencement of operation, carriage 42 is at its rearward position (see FIG. 2), the upper carriage 51 is at its full up position and the lower carriage portion 52 at its lowermost position. Rod 61 is at its maximum extension out of cylinder 53. At this time, sheets 27 are positioned on conveyor 31 directly opposite the machine, the spine edges of the sheets being squared against the rail 32. Similarly, the male strips 22 are driven by their transverse feed mechanism from their cassettes along the male strip driver bar 140 until they are centered relative to the machine and the female strips 23 are driven from their cassettes by transfer mechanism along the upper surface of rail 78.

Figure 8:
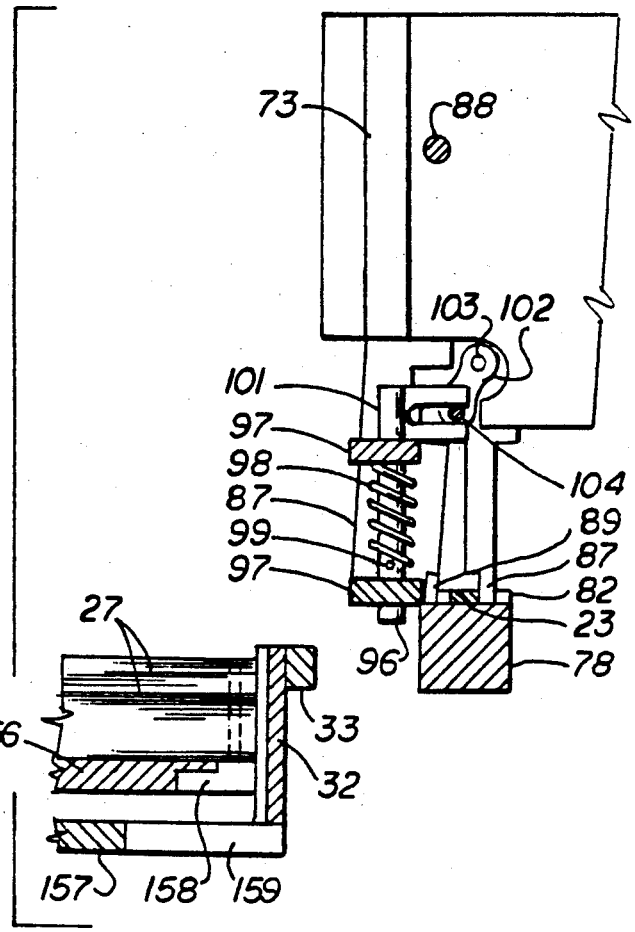
FIG. 8 is a sectional view taken substantially along line 8—8 of FIG. 1.
Figure 8A:
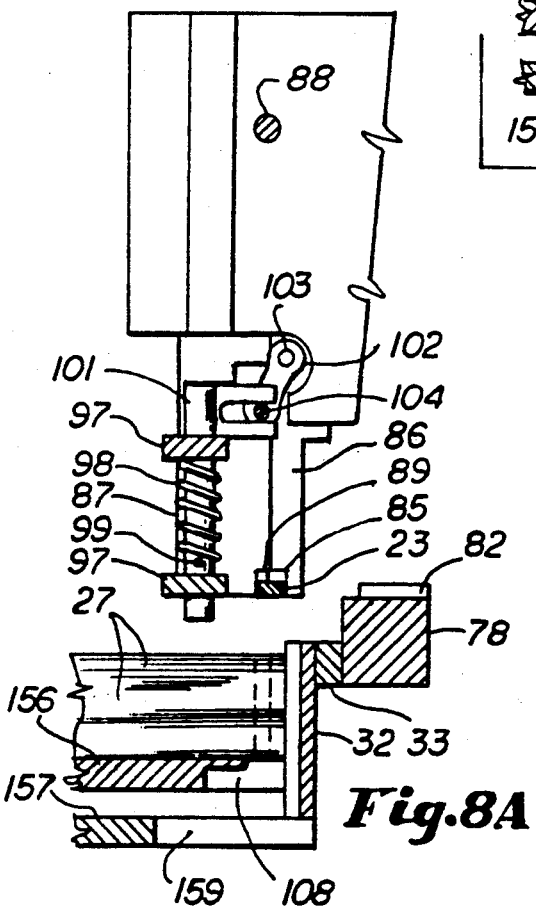
FIGS. 8A and 8B are views similar to FIG. 8 showing the machine in different positions in its cycle of operation.

The first step in the operation of the automatic binding machine is the energization of the cylinder 39 which causes the rod 41 to push the carriage 42 to the left, as viewed in FIG. 2 or to the right as viewed in FIGS. 7 and 8. The forward face of rail 78 engages projection 33 of rail 32 of conveyor 31 and continued movement to the right, as viewed in FIGS. 7A and 8A, stops the motion of rail 78. This allows the clamp 87 to pivot clockwise under the force of spring 91, as viewed in FIG. 8A, with the result that the ends of clamps 87 engage the extreme outer ends of strip 23, clamping the strip 23 against strip stop arm 86, holding it up despite retraction of rail 78.

Figure 8B:
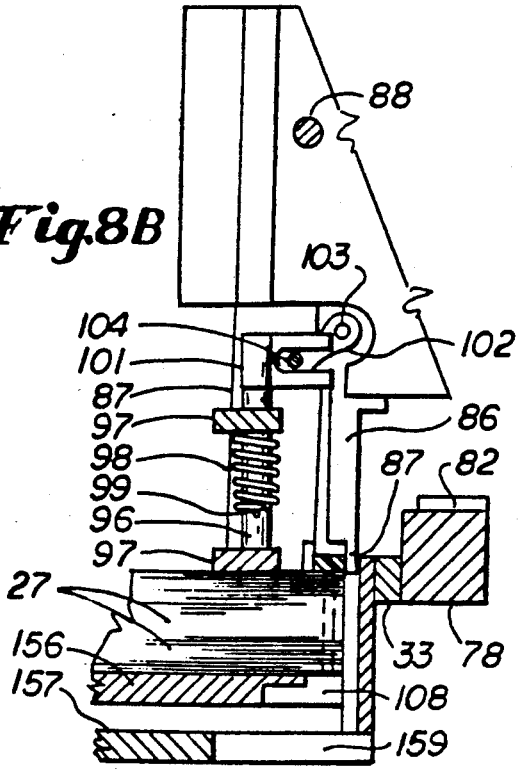

Thereupon cylinder 53 is energized to partially retract rod 61. Because of the force of springs 122, such retraction does not cause rotation of crank shaft 64 but, on the contrary, the entire upper carriage portion 51 is lowered along the ways 48. As the bottom face of the strip 23 approaches the top of the stack of sheets 27, the reset rod 96 engages the same, (see FIGS. 7B and 8B) thereby causing the rod 96 to move up relative to the upper carriage portion 51, thereby moving pin 104 into notch 126 holding clamp arm 87 open and releasing strip 23 from clamp 87. Pin 104 seats in step or notch 126, latching clamp 87 outward. The fact that the clamp 87 is open prevents the clamp from grabbing strip 23 as the subassembly later retracts to upward position.

Continued retraction of rod 61 in cylinder 63 still does not cause rotation of the crank shaft 64 by reason of the opposition of springs 122. Instead, the lower carriage portion 52 rises on ways 48. Thus, the driver rods 139 raise male strip driver bar 140 causing strip 21 to be pushed upward. When the upper ends of studs 22 engage the funnel blocks 149, they cause the blocks 149 and guides 146 to pivot outward, as viewed in FIG. 4, about pivots 147 against the force of springs 148. Continued rising of strip 21 causes the studs to pass through the holes 28 in sheets 27 and thence through the holes 24 in strip 23.

Figure 3B:
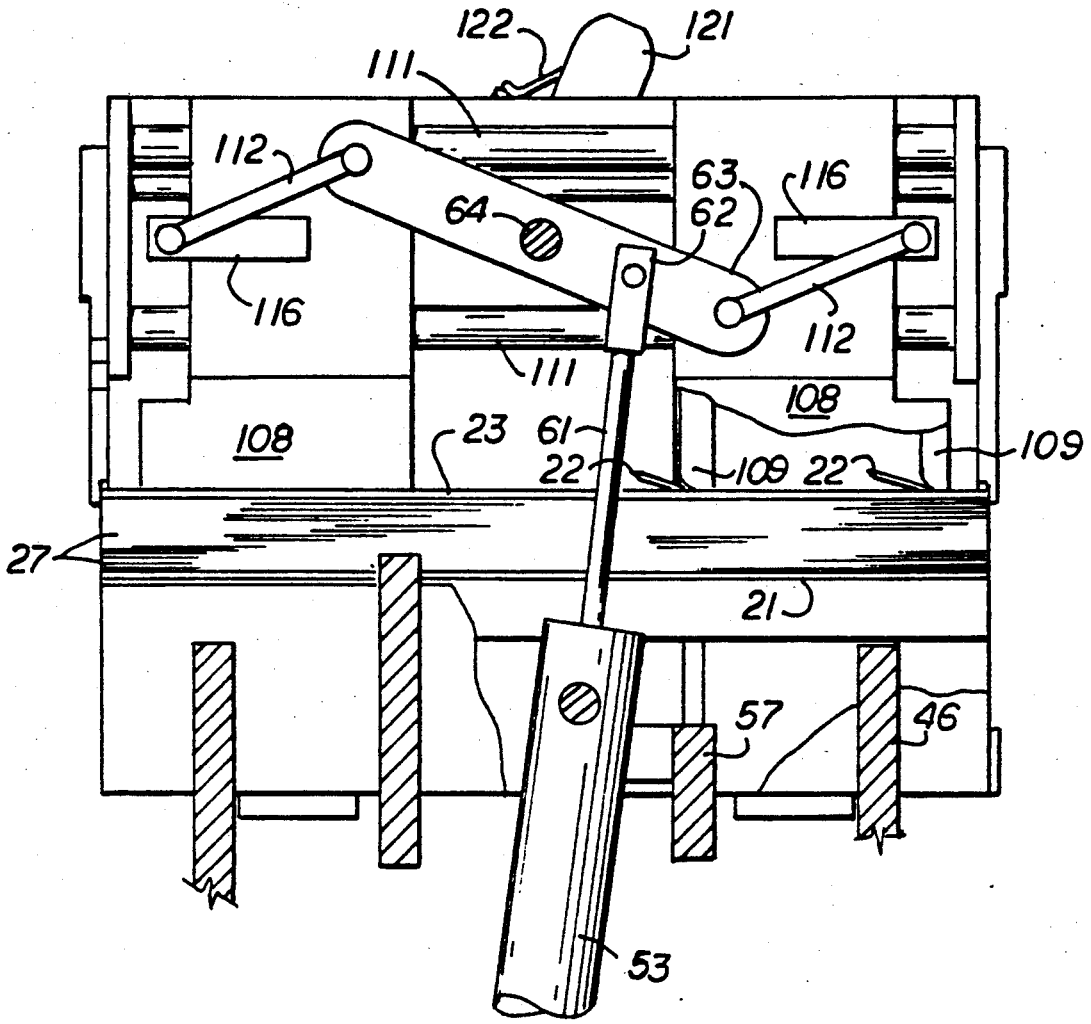
Figure 3C:
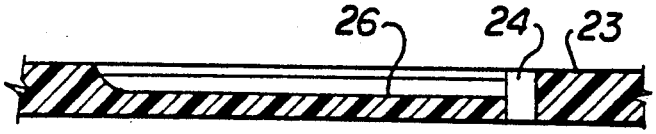
FIG. 3C is an enlarged fragmentary sectional view of a portion of one of the binding strips shown in FIG. 3B.

When the section 51 is fully down and the strip 52 is in contact with the paper, continued retraction of rod 61 overcomes the force of the springs 122, causing the arm 63 to turn in a clockwise direction, as viewed in FIG. 3. This movement pulls the blocks 106 inward toward the center of the machine Directing attention to FIGS. 3B and 5, the inward pull of blocks 106 causes the legs 108 and 109 to bend the lengths of the studs 22 projecting above the level of strips 23 toward the center of the strips and to force the ends of the studs downward into the grooves 26. This completes the bind of the book.

Projection of rod 61 reverses the positioning of the carriage sections 51 and 52 to their initial positions, whereupon the completed book remains in the tray 31. Carriage 42 is then retracted by means of the cylinder 39 to its initial position. When the subassembly returns to the position of FIG. 8, rail 78 forces clamp 87 out, releasing link 102 and resetting the latch.

An additional strip 21 and an additional strip 23 may be fed into the machine. Meanwhile, tray 31 is moved away and a new tray 31 bearing new sheets 27 is brought into position for repetition of the cycle of operation.

What is claimed is:

1. Apparatus for binding books from a plurality of sheets formed spaced along one edge with a plurality of first holes, a first binding strip comprising a thin narrow member having flexible studs projecting therefrom spaced the same distances as the first holes and a second thin narrow binding strip formed with second holes spaced the same distances as the first holes and having grooves extending inwardly from each second hole, said apparatus comprising first support means supporting the sheets with the first holes aligned, a carriage, a first section mounted on said carriage, second support means for supporting a first binding strip on said first section, a second section on said carriage supporting a second binding strip with the second holes aligned with the studs, ways on said carriage guiding relative movement of said first and second sections, transport means for moving the sheets and said carriage relative to each other until the first holes are aligned with the studs, advancing means for advancing the first binding strip on said ways in the direction of the studs until the studs penetrate the first and second holes, and bending means on said second section for bending into the grooves the portions of the studs extending beyond the second strip.

2. Apparatus according to claim 1 in which said ways are parallel to the studs and a second section mounted on said ways and which further comprises second advancing means for advancing said second section on said ways toward said first section.

3. Apparatus according to claim 2 in which said second advancing means comprises resilient means, said resilient means applying a predetermined pressure against the second strip to govern the pressure applied by the first strip against the sheets.

4. Apparatus according to claim 3 in which said bending means is operable only after said pressure has been attained.

5. Apparatus according to claim 1 in which said second support means comprises a first strip support rail on which the first strip rests, strip guide means for holding the studs perpendicular to said first strip support rail, pivot means pivotally mounting said guide means relative to said carriage, said advancing means advancing said first strip support rail toward said second section.

6. Apparatus according to claim 5 in which the first strip pivots said guide means to inoperative position as said advancing means advances said first strip support rail.

7. Apparatus according to claim 1 in which said bending means comprises at least two shafts transverse to the studs, a pair of blocks reciprocable on said shafts, each said block having a first position outward of the outermost of the second holes and a second position inwardly of said first position, and block moving means for moving said blocks between first and second positions, whereby said blocks bend the portions of the studs down parallel to second strip and into grooves.

8. Apparatus according to claim 7 in which there are at least four first holes, second holes and studs and each said block has at least two feet, the outermost ends of said feet riding along the second strip, whereby each said block bends at least two studs.

9. Apparatus according to claim 7 which further comprises second portion advancing means for advancing said second portion toward said first portion to advance the second strip toward the sheets prior to the studs penetrating the first holes.

10. Apparatus according to claim 9 which further comprises operating means for sequentially operating said second portion advancing means, said first-mentioned advancing means and said block moving means.

11. Apparatus according to claim 10 in which said operating means comprises a pressure cylinder.

12. Apparatus according to claim 11 in which said cylinder is pivotally attached to said first mentioned advancing means, said cylinder having a rod, a crank shaft oscillatable in said second section, a crank on said crankshaft, said rod being connected to said crank, resilient means resisting oscillation of said crank shaft, said block moving means being actuated by oscillatory movement of said crankshaft after said resilient means is overcome.

13. Apparatus according to claim 12 in which said rod first moves said second section toward said first section to a stop on said carriage and then moves said advancing means for advancing the first strip toward said second section before said resilient means is overcome

14. Apparatus according to claim 1 which further comprises a frame, means for reciprocating said carriage relative to said frame in a direction transverse to the direction of movement of said advancing means toward and away from said first support means.

15. Apparatus according to claim 14 which further comprises a second strip rail on said carriage, means biasing said second strip rail toward said first support means as said carriage moves toward said first support means, said second strip rail initially supporting the second strip, said first support means engaging said second strip rail as said carriage moves toward said first support means to move said second strip rail to inoperative position against the force of said means biasing said second strip rail, whereby the second strip is supported by the sheets.

16. Apparatus according to claim 15 which further comprises retractable clamps on said second section adapted to support the outer ends of the second strip as said second strip rail is moving to inoperative position.

17. Apparatus according to claim 16 which further comprises means for moving the second strip toward the sheets when said second strip rail is in inoperative position.

18. Apparatus according to claim 17 which further comprises means engaging the sheets as the second strip rests on the sheets, said last-named means retracting said clamps.

* * * * *